US006991126B2

(12) United States Patent
Jäckel

(10) Patent No.: US 6,991,126 B2
(45) Date of Patent: Jan. 31, 2006

(54) DISPENSING CLOSURE FOR A CONTAINER THAT HOLDS POURABLE MATERIAL

(75) Inventor: Gerhard F. K. Jäckel, Freyung (DE)

(73) Assignee: Seaquist-Loffler Kunststoffwerk, Freyung (DE)

( * ) Notice: Subject to any disclaimer, the term of this patent is extended or adjusted under 35 U.S.C. 154(b) by 0 days.

(21) Appl. No.: 10/490,198

(22) PCT Filed: Sep. 20, 2002

(86) PCT No.: PCT/EP02/10603

§ 371 (c)(1),
(2), (4) Date: Jun. 22, 2004

(87) PCT Pub. No.: WO03/024826

PCT Pub. Date: Mar. 27, 2003

(65) Prior Publication Data

US 2005/0061814 A1 Mar. 24, 2005

(30) Foreign Application Priority Data

Sep. 20, 2001 (DE) ..... 201 15 489

(51) Int. Cl.
*B65D 43/18* (2006.01)

(52) U.S. Cl. ..... 220/259.1; 220/717; 222/490

(58) Field of Classification Search ..... 220/259.1, 220/254.3, 711, 716, 717; 215/229, 388; 222/490, 541.5; B65D 55/02, 47/08
See application file for complete search history.

(56) References Cited

U.S. PATENT DOCUMENTS 5,346,081 A 9/1994 Lin
5,927,566 A * 7/1999 Mueller ..... 222/490
5,975,354 A * 11/1999 Goncalves ..... 222/39
6,050,434 A * 4/2000 McNab ..... 215/235
6,056,142 A * 5/2000 Elliott ..... 220/278

(Continued)

FOREIGN PATENT DOCUMENTS

DE 201 15 498 U 12/2001

(Continued)

OTHER PUBLICATIONS

English language International Search Report for PCT/EP02/10603.

(Continued)

*Primary Examiner*—Lien M. Ngo
(74) *Attorney, Agent, or Firm*—Wood, Phillips, Katz, Clark & Mortimer

(57) ABSTRACT

A dispensing closure (10) for a drinks container, having a closure body (100), the passage opening (126) of which is in communication with the outlet opening of the container, a closure element (200) and a flexible dispensing tube (300). A pinch member (280) is arranged on the closure element (200), and a mating holder (180) is arranged on the closure body (100). A cover (120) of the closure body (100) has a stepped stub (124) with an outlet opening (126) for the flexible dispensing tube (300). The flexible dispensing tube (300) is matched to the stub (124). An annular shoulder of the flexible dispensing tube (300) bears against an annular stop face (130) of the flexible tube holder (122, 124) and is widened by an annular bead (332) which engages in an annular groove (132) of the second step (134). The flexible dispensing tube (300) covers the annular shoulder (122). When the closure element is being closed, the head plate (210) can be fitted over the flexible tube holder (122, 124), in such a manner that the flexible dispensing tube (300) can be bent over by means of this pinch member (280).

8 Claims, 4 Drawing Sheets

U.S. PATENT DOCUMENTS

| | | | | |
|---|---|---|---|---|
| 6,112,951 | A * | 9/2000 | Mueller | 222/490 |
| 6,269,986 | B1 * | 8/2001 | Gross | 222/541.5 |
| 6,279,773 | B1 | 8/2001 | Kiyota | |
| 6,305,563 | B1 * | 10/2001 | Elliott | 215/235 |
| 6,609,624 | B2 * | 8/2003 | Goto et al. | 220/259.1 |

FOREIGN PATENT DOCUMENTS

| | | | |
|---|---|---|---|
| EP | 1 095 599 | A | 5/2001 |
| JP | 11189261 | A | 7/1999 |
| JP | 2001180720 | A | 3/2001 |

OTHER PUBLICATIONS

English language International Preliminary Examination Report for PCT/EP02/10603.

English language Abstract from the European Patent Abstract Of Japan for JP Publication No. 11189261 (Jul. 13, 1999).

English language Abstract from the European Patent Office Patent Abstract Of Japan for JP Publication No. 2001180720 (Jul. 13, 1999).

* cited by examiner

DISPENSING CLOSURE FOR A CONTAINER THAT HOLDS POURABLE MATERIAL

This application is an application filed under 35 U.S.C. Sec. 371 as a national stage of international application PCT/EP02/10603, which was filed Sep. 20, 2002.

BACKGROUND OF THE INVENTION

The invention relates to a dispensing closure for containers which contain free-flowing substances, in particular for drinks containers.

Numerous designs of dispensing closures of this type are known from the prior art and are used for drinks containers made from various materials, in particular from glass and plastics.

In particular in recent years, increased demands have been imposed on drinks containers of this type and associated dispensing closures for different intended applications and uses. To allow the drinks containers to be carried along without problems and to allow the dispensing closures to be actuated easily and ergonomically, in particular in the outdoors or during sporting pursuits, e.g. when running, riding a bicycle, and also, for example, when driving a motor vehicle, various solutions and materials have been used.

BRIEF SUMMARY OF THE INVENTION

It is an object of the present invention to provide an improved dispensing closure for containers which contain free-flowing substances, in particular for the abovementioned drinks containers, which on the one hand can be operated and handled easily and without problems and also allows comfortable removal of the free-flowing substance, and on the other hand is of a design which offers a high degree of reliability even with frequent use and possibly careless handling, allows the container to be reliably sealed in the long term in particular in a closed state and, furthermore, has no adverse effect on the removal process, in particular the pleasure associated with drinking.

This object is achieved by a dispensing closure for containers which contain free-flowing substances, in particular for drinks containers, comprising a closure body having a cover, from the outer edge of which projects a casing which can be secured to the container over an outlet opening thereof, a passage opening in the top side of the closure body, which opening is in communication with the outlet opening of the container, a closure element, which is connected to the closure body and can be moved between a position in which it closes off the passage opening of the closure body and a position in which it opens up the passage opening of the closure body, a flexible dispensing tube, the passage opening of the closure body being designed in such a way that it can accommodate the elastic dispensing tube for the free-flowing substance, which can be sealed by being pinched shut when the closure element moves out of the open position into the closed position, and in which the closure element is provided with a pinch member, the closure body is provided with a mating holder, in such a manner that when the closure element is being closed, the flexible dispensing tube can be moved on to the mating holder by the pinch member in order to pinch shut the flexible dispensing tube in a sealing manner, the pinch member is arranged on the underside of a head plate of the closure element, and the mating holder is arranged on the top side of the closure body, the pinch member and the mating holder, in the closing position of the closure element, are arranged in such a way that the distance between them in the area into which the flexible dispensing tube is forced by the closure element closing corresponds to at most the thickness of the flexible dispensing tube which has been sealed by pinching, such that the pinch member, in the closed position of the closure element, pinches the flexible dispensing tube shut on the mating holder in a sealing manner, the closure element forms a flap lid which is articulatedly mounted integrally on the closure body by a hinge, and in which the cover of the closure body is designed as a flexible tube holder with a radially outer annular shoulder and a radially inner dome-like elevation, the diameter of the dome-like elevation being stepped over the height of this elevation, and the dome-like elevation having, at its outer end, an outlet opening for an outer section of the length of the flexible dispensing tube, the internal and external diameters of a section of the length of the flexible dispensing tube which is arranged inside the stepped flexible tube holder are matched to the steps in the internal diameter of the flexible tube holder, a first step is provided by cylindrical widening of the flexible tube holder below its outlet opening, the lower end of this first step of the flexible tube holder forms an inner, annular stop face, which at the same time delimits an annular groove inside a second step, the diameter of which is widened with respect to the first step, the widening of the second step below the annular groove is of frustoconical configuration and, at the lower end, merges into the horizontally positioned annular shoulder which faces the edge of the container opening and from the outer edge of which the securing casing of the closure body extends toward the container, the flexible dispensing tube has a widened diameter at a distance below the outlet opening of the axially stepped flexible tube holder and at the lower end of this widening has an annular shoulder, by means of which the flexible dispensing tube bears against the annular stop face of the flexible tube holder, the annular shoulder of the flexible dispensing tube is widened by an annular bead which engages into the annular groove of the second step of the flexible tube holder, the flexible dispensing tube has a cylindrical section of its length extending from its annular shoulder to an inner edge of the annular shoulder of the cover and has a disk-like widening which substantially covers the underside of the annular shoulder of the cover, an underside of a head plate of the closure element is provided with a pinch member which, when the closure element is being closed, can be fitted over the flexible tube holder which forms the mating holder, in such a manner that when the closure element is being closed the flexible dispensing tube can, by means of this pinch member, be bent over the edge of the passage opening of the flexible tube holder and can be sealed by being pinched shut.

The advantageous design of the dispensing closure according to the invention, and in particular the provision of a flexible dispensing tube for the free-flowing substance, which leads through a passage opening in the closure body, allows comfortable and pleasant removal of the substance, in particular a liquid, from the container, while ensuring that, for example even when undertaking sporting pursuits and in the event of vibrations which may be induced by such pursuits, the substance is dispensed reliably and is not shaken up.

Safe and reliable securing of the flexible dispensing tube to the flexible tube holder and therefore to the closure body of the container is made possible in particular by the way in which the design of the flexible dispensing tube, on the one hand, and the flexible tube holder, on the other hand, are matched to one another in accordance with the invention, yet at the same time it is still ensured that the flexible dispensing tube has a certain freedom of movement or flexibility in particular in its upper region, which in particular facilitates handling without the sealing properties of the dispensing closure being adversely affected. Furthermore, the design is configured in such a way that on the one hand the dispensing closure can be produced easily and therefore at low cost, and on the other hand it is possible for the individual elements of the dispensing closure to be dismantled, for example in order to be cleaned, and also they can be reassembled repeatedly and without problems even by an unskilled person and without tools, without the functionality of the dispensing closure, in particular its sealing properties, being adversely affected.

The hinge used is preferably an integral hinge, in particular what is known as a "dead center hinge", which, when the closure element is moved beyond a certain opening angle or dead center position, automatically snaps into the position which opens up the closure body on account of forces exerted by the dead center hinge, and vice versa. This allows particularly simple and comfortable operation of the dispensing closure.

In a particularly preferred embodiment, the dispensing closure is designed in such a way that the pinch member is designed substantially in the form of a continuous curve with different radii, the radii being selected in such a way that the pinch member, in the closed position of the closure element, bears, by means of its side which faces the hinge, against that side of the flexible tube holder which faces the hinge, whereas that side of the pinch member which is remote from the hinge, in the closed position of the closure element, opposite that side of the flexible tube holder which is remote from the hinge, forms, together with the flexible tube holder, a free space for accommodating the bent-over, free end of the flexible dispensing tube.

An advantageous configuration of the pinch member of this nature on the one hand ensures that, while the closure element is closing, the flexible dispensing tube which projects above the passage opening in the closure body is always bent over in a controlled, identical way, and on the other hand in the closed position of the closure element, closing off the closure body, the dispensing closure ensures a reliable seal with respect to the container which contains the free-flowing substance.

Further advantageous embodiments of the dispensing closure according to the invention are characterized in that a substantially cylindrical through-channel in the flexible dispensing tube is widened in steps toward its inner end, matching the stepped contour of the flexible tube holder, with the flexible dispensing tube preferably consisting of a soft material, in particular silicone.

Furthermore, it is preferable for the dispensing closure according to the invention additionally to have a sleeve element which covers at least part of the flexible tube holder. This is advantageous in particular in the case of dispensing closures which are used for drinking bottles, since this provides the user with a more pleasant feeling when he is drinking. A sleeve element of this type preferably consists of a similar material to the flexible dispensing tube, if appropriate also from a slightly harder material. Examples of preferred materials for the sleeve element include silicone or rubber, without the invention being particularly restricted to any specific material.

BRIEF DESCRIPTION OF THE DRAWINGS

These and further advantages and features of the dispensing closure according to the invention will become still clearer from the appended drawings, in which.

DETAILED DESCRIPTION OF THE INVENTION

Figure 1:
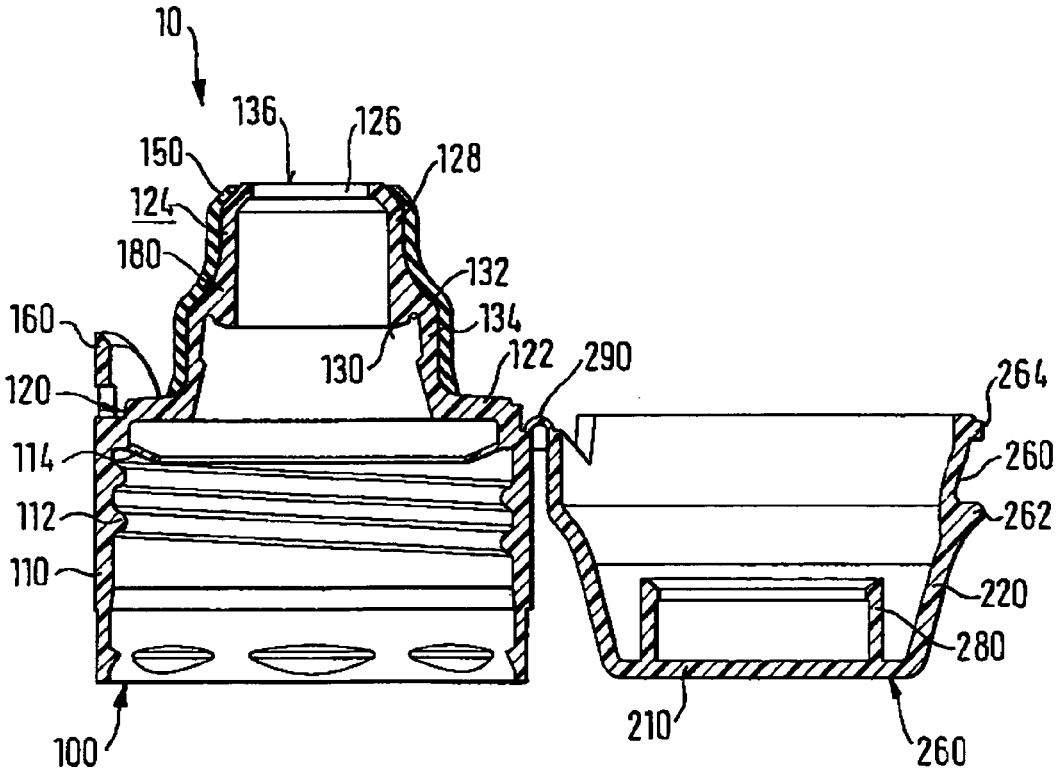
FIG. 1 shows a cross-sectional illustration through a first embodiment of a dispensing closure according to the invention (without flexible dispensing tube), with a closure element in an open position.

FIG. 1 shows a cross section through a first embodiment of a dispensing closure 10 according to the invention for containers which contain free-flowing substances, having a closure body 100 and a closure element 200 designed as a lid. Closure body 100 and closure element 200 are connected integrally to one another by means of a hinge 290, which in this embodiment is designed as an integral hinge, so that the closure element 200 can be pivoted out of the position in which it opens up the closure body as shown in FIG. 1 into the position in which it closes off the closure body, by being pivoted through 180° about an axis formed by the integral hinge 290.

Figure 2:
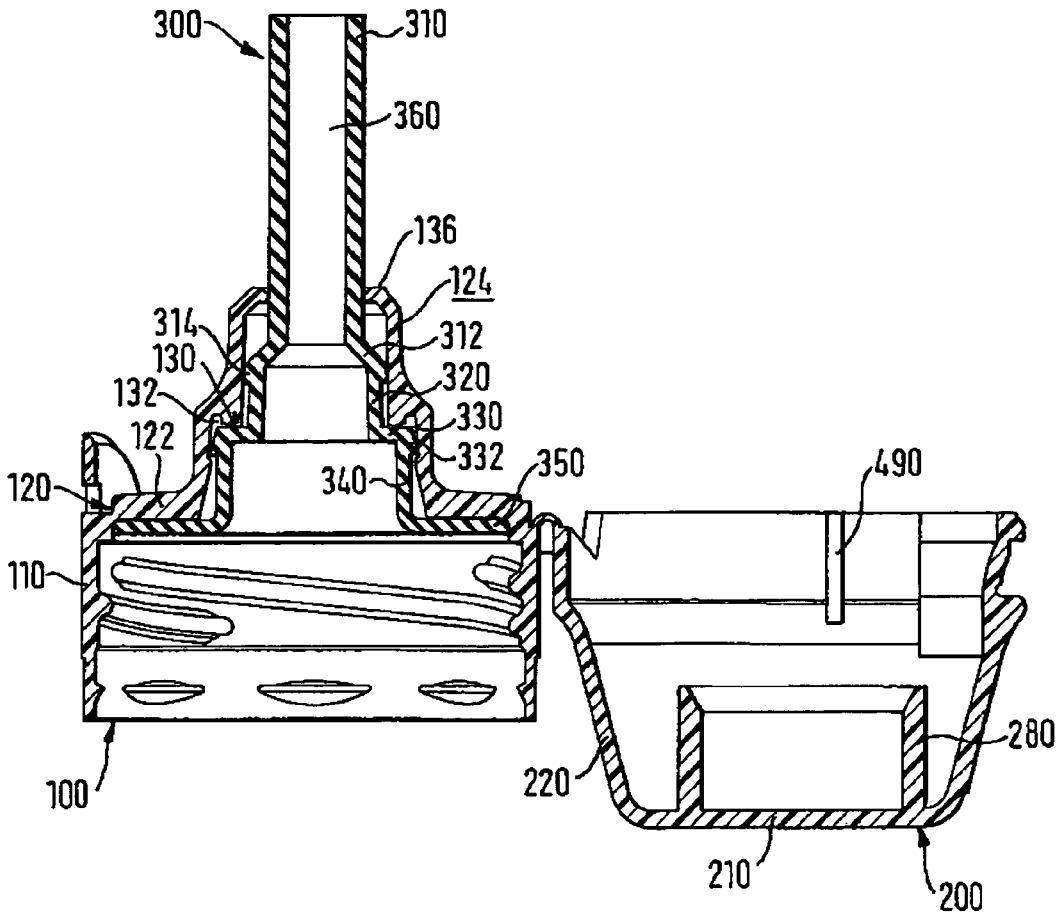
FIG. 2 shows a cross-sectional illustration through a second embodiment of a dispensing closure according to the invention, with a closure element in an open position.

To provide a clearer illustration of the individual elements, in particular the closure body 100, the flexible dispensing tube (300, cf. FIG. 2) provided for this embodiment is not shown in FIG. 1. However, the flexible dispensing tube which is to be used in the embodiment of the dispensing closure shown in FIG. 1 corresponds to the flexible dispensing tube as shown in FIG. 2.

On its top side, the closure body 100 has a cover 120, from the radially outer edge of which a casing 110 extends downward. The casing 110 is of substantially cylindrical design and has an internal screw thread 112, so that it can be secured on a container (not shown) by being screwed on to a corresponding mating thread on the container.

As an alternative to the screw connection, it is also possible to provide other means for securing the closure body to a container, for example snap-action connections. It is also possible for the dispensing closure to be formed directly, integrally with a corresponding container.

In the embodiment shown in FIG. 1, a sealing lip 114, which is designed in the form of a ring which is inclined downward slightly with respect to the horizontal, is provided in the upper region of the casing 110 of the closure body 100, in the vicinity of the outer edge of the cover 120 of the closure body 100, so that this sealing lip 114, when the closure element 100 is being screwed on to the container, presses onto a top side of the container opening and forms a seal against it.

In the embodiment shown here, the sealing lip 114 is formed integrally with the closure body but consists of a soft material, in this case silicone, unlike the hard plastic from which the closure body 100 and also the closure element 200 of the dispensing closure 10 are made. However, at this point it should be noted that in another embodiment the sealing lip may be made from the same material as the closure body, which simplifies the production process.

On its top side, the closure body 100 is provided with the cover 120, which has a substantially horizontal annular shoulder 122, from which a radially inner central stub 124 extends in the manner of a dome and in stepped form outward beyond the annular shoulder. The diameter of the dome-like stub 124 is stepped over the height of the stub, and the stub 124 has an outlet opening 126 at its outer end.

The dome-like stub 124 substantially comprises a first (or upper) step 128, which, with respect to the cover 120, lies above a second (or lower) step 134. Each of the steps 128, 134 is substantially cylindrical in form, with the two steps 128, 134 having similar heights, but the first step 128 having a smaller diameter.

The transitions between the first step 128 and the second step 134 and between the second step 134 and the annular shoulder 122 on the outer side are rounded, so that there are no sharp edges.

Above the first step 128 there is a termination rim 136 which is angled off radially inward and in its top region runs virtually horizontally. This termination rim 136 surrounds the passage opening 126, in such a manner that the passage opening 126 has an internal diameter which corresponds to the external diameter of an upper region of a flexible dispensing tube (FIG. 2).

The inner region of the dome-like stub 124 of the cover 120 is stepped in terms of its internal diameter. Below the internal diameter of the passage opening 126, which is the smallest internal diameter within the dome-like stub 124, the internal diameters of the dome-like stub 124 widen out downward or inward, i.e. toward the container. After the first widening of the internal diameter immediately below the termination rim 136, the inner region extends substantially cylindrically over the entire axial extent of the first step and widens out further approximately at the height of the transition region between the first step 128 and the second step 134.

The lower end of the first step 128 of the flexible tube holder 180, in the inner region, forms an annular stop face 130, which at the same time delimits an annular groove 132 in the upper region within the second step 134. The inner region of the second step 134 below the annular groove 132 has a frustoconical profile and widens out downward, merging at its bottom end into the lower side of the horizontally positioned annular shoulder 122 of the cover 120.

Furthermore, the embodiment shown in FIG. 1 has a sleeve element 150 which consists of silicone, extends substantially over the entire outer region of the dome-like stub 124 of the cover 120 and follows the contour of the dome-like stub 124.

The closure element 200 is substantially designed in the form of a lid and comprises a head plate 210 and a side region 220 which extends from the head plate, the side region 220 substantially being designed in such a way that, in a closed position of the closure element 200, it is substantially flush with the casing 110 of the closure body 100.

Furthermore, on its opposite side from the hinge 290, the closure element 200 has a groove 260 for receiving a quality assurance element 160, the groove 260 (in the lower region in the position of the closure element 200 shown in FIG. 1, and therefore in the upper region in the closed position) being recessed inward, so that the quality assurance element 160 can be pressed into this recessed region in order to break the seal. The groove 260 for the quality assurance element 160 is delimited by a lug 262 and a protuberance 264 in its upper and lower regions.

On the inner side of the head plate 210 of the closure element 200 there is a pinch member 280 which is designed substantially in the form of a curve, but with a varying radius. The way in which the pinch member 280 functions, and also its precise configuration, will become clear in particular in conjunction with FIG. 3 and FIG. 4, which are explained below.

FIG. 2 shows a second embodiment of the dispensing closure according to the invention, which is very similar to the first embodiment. Therefore, identical and similar elements are provided with identical reference numerals, and for a detailed description reference is made in particular to the description given in connection with FIG. 1.

As can be seen from a comparison with the embodiment illustrated in FIG. 1, the casing 110 of the closure body 100 is of shorter design, so that it does not extend as far beyond the area of the opening of an associated container.

The dome-like stub 124 of the cover 120 is identical to the embodiment shown in FIG. 1, but does not have a sleeve element (150, FIG. 1) for covering the dome-like elevation 124.

In the embodiment shown in FIG. 2, a flexible dispensing tube 300 is fitted into the flexible tube holder formed from the cover 120 and from the annular shoulder 122 and the dome-like stub 124. At this point, it should be noted once again that an identical flexible dispensing tube 300 can also be used in the embodiment shown in FIG. 1.

The flexible dispensing tube 300, which consists of silicone, is matched to the inner contour of the cover 120 and likewise has a stepped diameter over its height. The flexible dispensing tube 300 substantially comprises three segments, a first or outer section 310 of its length, a second section 320 of its length and a third section 340 of its length, with the diameter of the first or outer section 310 of its length being smaller than the diameter of the second section 320 of its length, which is in turn smaller than the diameter of the third section 340 of its length.

Between the first or outer section 310 of its length and the second section 320 of its length, there is an inclined, frustoconical transition 312, which at its lower end has a protruding bead 314 directly above the second section 320 of its length. The external diameter of the bead 314 corresponds to the internal diameter of the first step 128 (FIG. 1) of the cover 120. The external diameter of the bead 314 may also be slightly larger than the internal diameter of the first step 128 (FIG. 1), so that an increased seal is achieved by the compression of the bead 314.

The external diameter of the second length section 320 is slightly smaller than the internal diameter of the first step 128 (FIG. 1) of the cover 120, so that increased flexibility of the flexible dispensing tube 300 is made possible, with the bead 314 ensuring both an additional sealing action and a guiding function for the flexible dispensing tube 300 in the flexible tube holder 122, 124.

Between the second length section 320 and the third length section 340 there is an annular shoulder 330 with an annular bead 332, which engages in the annular groove 132 in the dome-like stub 124, so that reliable anchoring and securing of the flexible dispensing tube 300 in the flexible tube holder 122, 124 is ensured.

The third length section 340, below the annular bead 332, extends substantially cylindrically downward, with an external diameter which is slightly smaller than the external diameter of the annular bead 132, and merges at its lower end into a disk-like widening 350 which engages around the underside of the annular shoulder 122 of the cover 120, so that accurate positioning and securing, and also sealing, of the flexible dispensing tube 300 in the closure body 100 is ensured.

The closure element 200 is substantially identical to the closure element 200 shown in FIG. 1, but additionally has an elongate positioning element 490 which is arranged on the inner side of the side region 220 of the closure element 200. At the end of the closing operation and in the closing position of the closure element 200, this positioning element 490 interacts with a mating positioning element (190, FIG. 4), which is arranged on the closure body 100 in the form of a projection, so that reliable and accurate positioning of the closure element 200 on the closure body 100 is assisted during the closing motion.

Figure 3:
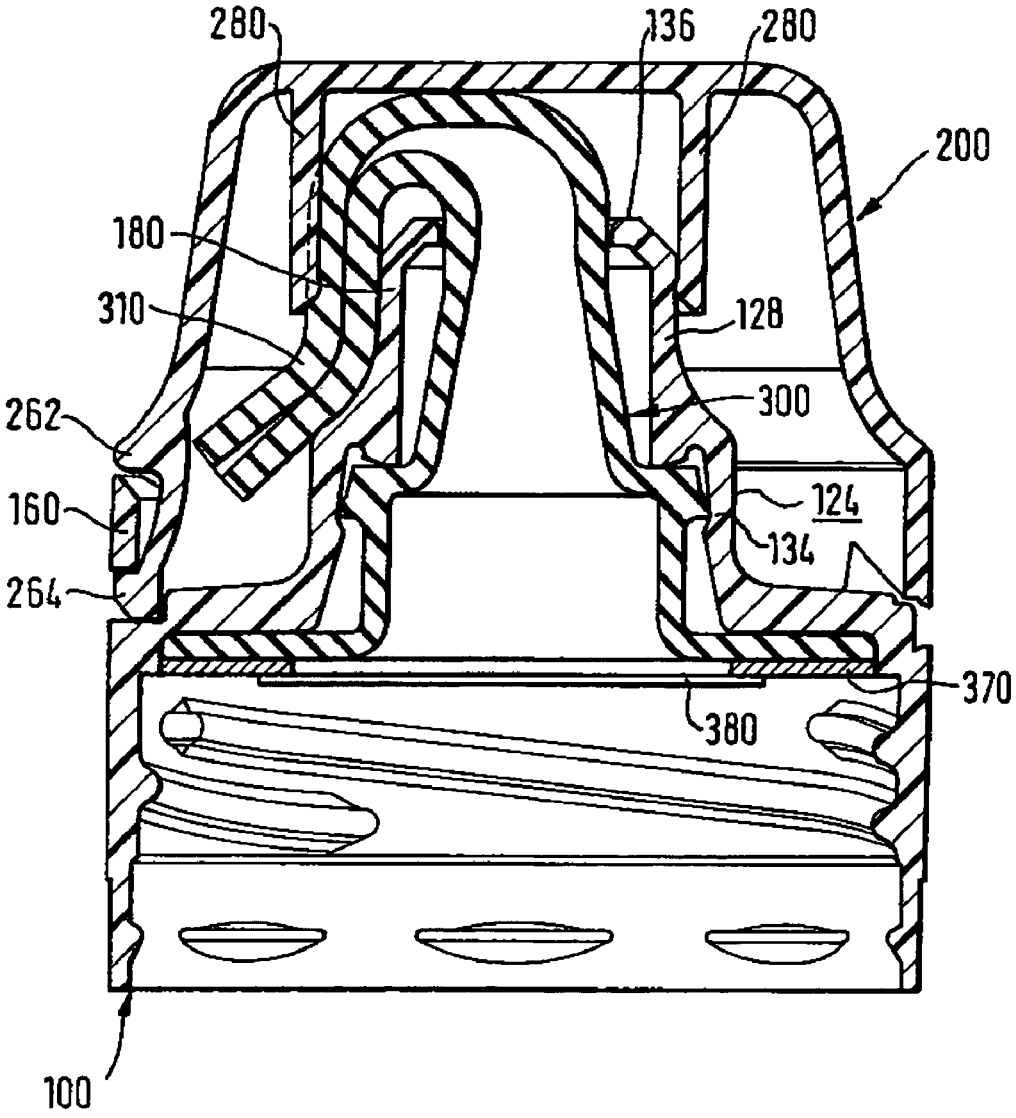
FIG. 3 shows a cross-sectional illustration through the embodiment of the dispensing closure according to the invention shown in FIG. 2, with the closure element in a closed position.

FIG. 3 shows a third embodiment of the dispensing closure according to the invention, the closure body 100 and the closure element 200 being identical to those of the embodiment shown in FIG. 2; only the flexible dispensing tube 300 varies slightly with respect to the flexible dispensing tube 300 shown in FIG. 2. Therefore, for a more detailed description and explanation of FIG. 3, reference is made to the description given in conjunction with FIGS. 1 and 2. In this case too, identical or similar components are provided with identical reference numerals.

In the embodiment shown in FIG. 3, the closure element 200 is in the closed position. It can be seen that the outer section 310 of the length of the flexible dispensing tube 300 has been bent substantially in the closing direction, i.e. away from the integral hinge 290, in FIG. 3 downward and to the left, around the dome-like elevation 124, in particular around the termination rim 136. Consequently, the flexible dispensing tube 300 is held and pressed together by the pinch member 280, on one side, and in particular the first step 128 of the dome-like stub 124, so that the outer section 310 of the length of the flexible dispensing tube 300 is sealed shut at this location. The first step 128, and in particular the transition region between the first step 128 and the second step 134, therefore serve as mating element 180 for the pinch member 280. As shown in FIG. 3, the transition region between the first step 128 and the second step 134 of the dome-like stub 124 is designed in such a way that the outer section 310 of the length of the flexible dispensing tube 300 can be bent without strong kinks being formed, which could damage the flexible dispensing tube 300.

The pinch member 280 and the dome-like stub 124 are designed in such a way that, in the closed position of the closure element 200 shown in FIG. 3, at the position at which the outer section 310 of the length of the flexible dispensing tube 300 comes to lie, a distance which corresponds to at most the thickness of the flexible dispensing tube which has been sealed shut by pinching, and in this case is slightly less than twice the wall thickness of the outer section 310 of the length of the flexible dispensing tube 300, remains in the radial direction between the first step 128 of the dome-like elevation 124 and the corresponding, opposite region of the pinch member 280, so that a reliable seal is ensured as a result of the walls of the flexible dispensing tube 300 being compressed.

Furthermore, the region or the pinch member 280 which faces the hinge 290, i.e. the right-hand region in FIG. 3, ends directly at the dome-like stub 124 and bears tightly against the outer region of the first step 128. This in particular results in accurate positioning, but at the same time also in a sealing effect and a stabilizing effect.

The flexible dispensing tube 300 shown in FIG. 3, unlike the flexible dispensing tube 300 shown in FIG. 2, does not have an annular bead 314, but rather runs substantially freely in the inner region of the first step 128 of the dome-like stub 124. Also, the flexible dispensing tube 300 does not have a transition region between the outer section 310 of its length and the second section 320 of its length. The second section 320 of its length directly adjoins the first section 310 of its length and runs substantially frustoconically until it reaches the angular shoulder 330. This results in increased flexibility of the flexible dispensing tube 300.

In addition, a sealing element 370—in this case in the form of a sealing ring—is arranged at the flexible dispensing tube 300, more specifically at the underside of the disk-like widening 350. Furthermore, there is a diaphragm 380, which is only diagrammatically indicated. The sealing element 370 does not form part of the invention and may optionally be used or omitted, for example depending on the product employed.

Figure 4:
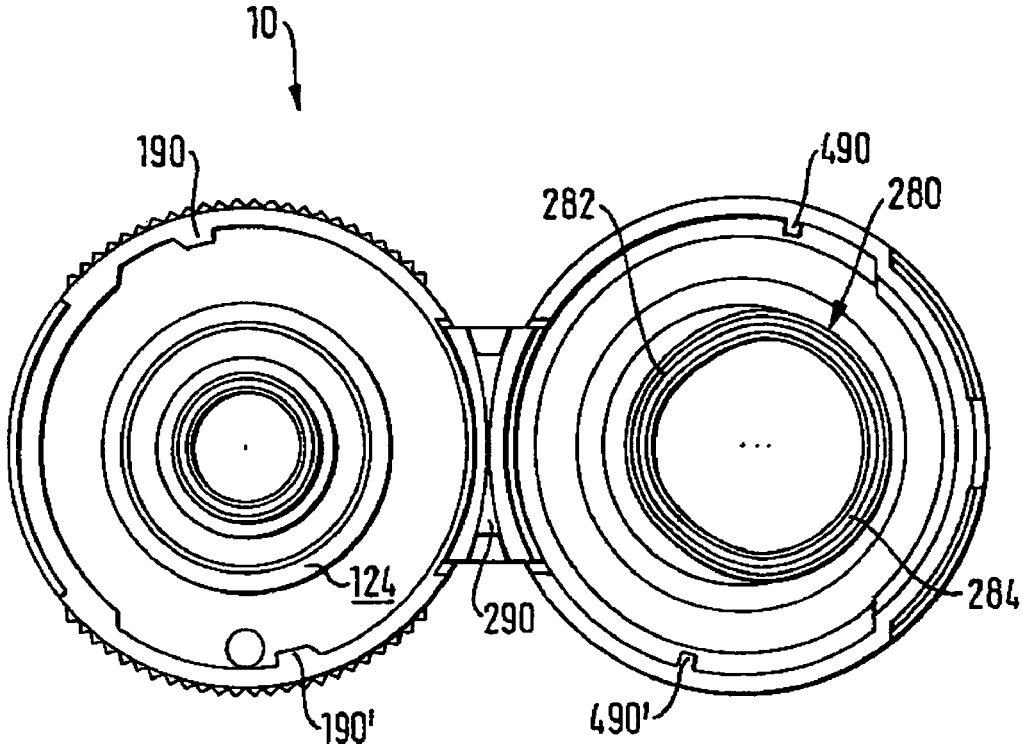
FIG. 4 shows a plan view of the open dispensing closure from FIG. 2.

FIG. 4 shows a plan view of an embodiment of a dispensing closure 10 according to the invention illustrating the shape of the pinch member 280. The pinch member 280 is designed substantially in the form of a curve, having a smaller diameter over an angular region of approx. 90° in the region 282 which faces the hinge 290, so that, as has been described in connection with FIG. 3, in the closed position of the closure element 200 it bears directly against the dome-like stub 124 of the closure body 100, whereas in its region 284 which is remote from the hinge, over the remaining angular region of approx. 270°, it has a larger diameter, so that the outer section 310 of the length of the flexible dispensing tube 300 (FIG. 3) can be pinched in a sealed manner between this region 284 and the dome-like stub 124 in the closed position of the closure element 200.

Of course, it is possible to deviate from the proposed angular division of the regions 282 and 294, for example to reduce the size of the angular region 284 which is remote from the hinge 290.

Furthermore, FIG. 4 shows the positioning element 490 arranged on the closure element 200 and the mating positioning element 190 arranged on the closure body 100, these two elements engaging with one another when the closure element 200 is closed, so that positioning of the closure element 200 on the closure body 100 is assisted. In addition, a further positioning element 94' and a further mating positioning element 190' are provided in FIG. 4, arranged on the circumference of the closure body 100 and of the closure element 200, substantially opposite one another.

The features which have been disclosed in the above description, the claims and the drawings may be of importance both individually and in any desired combination for realizing the various configurations of the invention.

What is claimed is:

1. A dispensing closure (10) for containers which contain free-flowing substances, in particular for drinks containers, comprising a) a closure body (100) having a cover (120), from the outer edge of which projects a casing (110) which can be secured to the container over an outlet opening thereof, b) a passage opening (126) in a top side of the closure body (100), which opening is in communication with the outlet opening of the container, c) a closure element (200), which is connected to the closure body (100) and can be moved between a position in which it closes off the passage opening of the closure body (100) and a position in which it opens up the passage opening of the closure body (100), d) a flexible dispensing tube (300), the passage opening (126) of the closure body (100) being designed in such a way that it can accommodate the elastic dispensing tube (300) for the free-flowing substance, which can be sealed by being pinched shut when the closure element (200) moves out of the open position into the closed position, characterized in that e) the closure element (200) is provided with a pinch member (280), f) the closure body (100) is provided with a mating holder (180), in such a manner that when the closure element (200) is being closed the flexible dispensing tube (300) can be moved onto the mating holder (180) by the pinch member (280) in order to pinch shut the flexible dispensing tube (300) in a sealing manner, g) the pinch member (280) is arranged on the underside of a head plate (210) of the closure element (200), and the mating holder (180) is arranged on the top side of the closure body (100), h) the pinch member (280) and the mating holder (180), in the closing position of the closure element (200), are arranged in such a way that the distance between them in the area into which the flexible dispensing tube (300) is forced by the closure element (200) closing corresponds to at most the thickness of the flexible dispensing tube which has been sealed by pinching, such that the pinch member (280), in the closed position of the closure element (200), pinches the flexible dispensing tube (300) shut on the mating holder (180) in a sealing manner, i) the closure element (200) forms a flap lid which is articulatedly mounted integrally on the closure body (100) by a hinge (290), j) the cover (120) of the closure body (100) is designed as a flexible tube holder with a radially outer annular shoulder (122) and a radially inner dome-like stub (124), the diameter of the dome-like stub (124) being stepped over the height of this stub, and the dome-like stub having, at its outer end, the passage opening (126) for an outer section (310) of the length of the flexible dispensing tube (300), k) the internal and external diameters of a section of the length of the flexible dispensing tube (300) which is arranged inside the stepped flexible tube holder (122, 124) are matched to the steps in the internal diameter of the flexible tube holder (120), l) a first step (128) is provided by cylindrical widening of the flexible tube holder (122, 124) below its passage opening (126), m) the lower end of this first step (128) of the flexible tube holder (122, 124) forms an inner, annular stop face (130), which at the same time delimits an annular groove (132) inside a second step (134), the diameter of which is widened with respect to the first step (128), n) the widening of the second step (134) below the annular groove (132) is of frustoconical configuration and, at the lower end, merges into the horizontally positioned annular shoulder (122) which faces the edge of the container opening and from the outer edge of which the securing casing (110) of the closure body (100) extends toward the container, o) the flexible dispensing tube (300) has a widened diameter at a distance below the outlet opening (126) of the axially stepped flexible tube holder (122, 124) and at the lower end of this widening has an annular shoulder (330), by means of which the flexible dispensing tube (300) bears against the annular stop face (130) of the flexible tube holder (122, 124), p) the annular shoulder (330) of the flexible dispensing tube (300) is widened by an annular bead (332) which engages into the annular groove (132) of the second step (134) of the flexible tube holder (122, 124), q) the flexible dispensing tube (300) has a cylindrical section (340) of its length extending from its annular shoulder (330) to an inner edge of the annular shoulder (122) of the cover (120) and has a disk-like widening (350) which substantially covers the underside of the annular shoulder (122) of the cover (120), r) the underside of the head plate (210) of the closure element (200) is provided with the pinch member (280), in such a manner that when the closure element is being closed, it can be fitted over the flexible tube holder (122, 124), which forms the mating holder (180), in such a manner that when the closure element (200) is being closed the flexible dispensing tube (300) can, by means of this pinch member (280), be bent over the edge of the passage opening (126) of the flexible tube holder (122, 124) and can be sealed by being pinched shut.

2. The dispensing closure as claimed in claim 1, characterized in that the closure element (200) is articulatedly mounted on the closure body (100) by means of an integral hinge (290).

3. The dispensing closure as claimed in claim 1, characterized in that the closure element (200) can be latched in the closed position with respect to the closure body (100).

4. The dispensing closure as claimed in claim 1, characterized in that the pinch member (280) is designed substantially in the form of a continuous curve with different radii, the radii being selected in such a way that the pinch member (280), in the closed position of the closure element (200), bears, by means of its side which faces the hinge (290), against that side of the flexible tube holder (122, 124) which faces the hinge (290), whereas that side of the pinch member (280) which is remote from the hinge (290), in the closed position of the closure element (200), opposite that side of the flexible tube holder (122, 124) which is remote from the hinge (290), forms, together with the flexible tube holder (122, 124), a free space for accommodating the bent-over, free end (310) of the flexible dispensing tube (300).

5. The dispensing closure as claimed in claim 1, characterized in that a substantially cylindrical through-channel (360) in the flexible dispensing tube (300) is widened in steps toward its inner end, matching the stepped contour of the flexible tube holder (122, 124).

6. The dispensing closure as claimed in claim 1, characterized in that the flexible dispensing tube consists of silicone.

7. The dispensing closure as claimed in claim 1, characterized in that the closure body (100) is provided with a sleeve element (150) which at least partially covers the flexible tube holder (122, 124).

8. The dispensing closure as claimed in claim 7, characterized in that the sleeve element (150) consists of a soft material, in particular silicone or rubber.

* * * * *